US007247044B2

(12) United States Patent
Rossi

(10) Patent No.: US 7,247,044 B2
(45) Date of Patent: Jul. 24, 2007

(54) REPEATABLY RELEASABLE CABLE CONNECTOR

(75) Inventor: Fredrick Rossi, Burlington, MA (US)

(73) Assignee: Scully Signal Company, Wilmington, MA (US)

( * ) Notice: Subject to any disclaimer, the term of this patent is extended or adjusted under 35 U.S.C. 154(b) by 0 days.

(21) Appl. No.: 11/447,234

(22) Filed: Jun. 5, 2006

(65) Prior Publication Data

US 2006/0276071 A1 Dec. 7, 2006

Related U.S. Application Data

(60) Provisional application No. 60/687,680, filed on Jun. 6, 2005.

(51) Int. Cl.
*H01R 13/627* (2006.01)

(52) U.S. Cl. ..... 439/352

(58) Field of Classification Search ..... 439/352–353, 439/488–489, 350, 259
See application file for complete search history.

(56) References Cited

U.S. PATENT DOCUMENTS 5,695,355 A 12/1997 Hasenfratz et al.
6,030,244 A * 2/2000 Buckheit et al. ..... 439/291
6,231,404 B1 5/2001 Lichy
6,488,520 B1 * 12/2002 Hayes et al. ..... 439/188
6,497,585 B2 * 12/2002 Torii ..... 439/352
6,679,730 B2 * 1/2004 Dye et al. ..... 439/606
7,066,759 B2 * 6/2006 Griffin ..... 439/352
2005/0014412 A1 * 1/2005 Wharton ..... 439/352
2006/0134962 A1 * 6/2006 Yeh ..... 439/352

FOREIGN PATENT DOCUMENTS

FR 2 749 984 A1 12/1997

* cited by examiner

*Primary Examiner*—J. F. Duverne
(74) *Attorney, Agent, or Firm*—Law Offices of Paul E. Kudirka

(57) ABSTRACT

A cable connector has male and female connector portions that slide together in a mating direction. The housing of one connector portion has a shoulder with a surface roughly perpendicular to the mating direction. The other connector portion has a resilient retainer spring attached thereto which extends parallel to the mating direction. When the connector portions are mated, the retainer spring has a finger which slips over the shoulder surface and is held in position by the resilience of the spring to provide a retention force that resists a separation of the male and female connector portions. However, the finger is shaped and resilience of the retainer spring is such that the finger will slip off the shoulder surface upon application of a sufficiently large separation force so that separation of the connector portions may occur without damage.

12 Claims, 5 Drawing Sheets

REPEATABLY RELEASABLE CABLE CONNECTOR

RELATED APPLICATIONS

This is a non-provisional application of application Ser. No. 60/687,680 which was filed on Jun. 6, 2005 by Fredrick Rossi entitled "Repeatably Releasable Cable Connector".

FIELD OF THE INVENTION

This application relates, generally, to the field of petroleum fuel loading and, more particularly, to the use of pump controllers for regulating the transfer of fuel from a loading station to a tanker truck.

BACKGROUND OF THE INVENTION

Petroleum pump controllers are well known for use in transferring fuel from loading stations to the tanks of trucks that then move the fuel to retail stations. Such controllers provide controls to the fuel transfer process that are beneficial for both safety and convenience. A number of different control features are typically provided, such as a test for ground continuity and an overfill prevention signal. To provide all of the desired controls, a multi-wire electrical cable connection may be provided between the truck to be loaded and the pump controller on the loading rack.

One popular type of cable for use with loading rack pump controllers has a multiple wire capacity and has a good seal to protect it from the environment. In addition, it has a locking mechanism built into the connector that, once engaged, resists separation of the connector portions. However, upon sufficient force, the locking mechanism will be irreparably broken, requiring either repair or replacement of the connector before it may be used again.

SUMMARY OF THE INVENTION

In accordance with the present invention, a repeatably releasable multi-wire cable connector is provided that includes male and a female connector portions. The male portion has a housing that may partially enclose a plurality of connector pins, each connected to a different wire of an adjacent cable. Such a housing has an opening adjacent to the connector pins that receives a female connector portion. The female connector portion mates with the male connector portion by a sliding of the connector portions toward each other in a mating direction. This results in the female connector portion fitting partially into the male connector portion so that a plurality of pin sockets of the female connector portion are engaged by the connection pins of the male portion.

At least one protrusion may extend from an outer surface of the male connector portion housing. This protrusion has a surface that is transverse to the mating direction, and two protrusions may be provided near each other so as to form a space between them. The female connector housing has a shoulder with at least one latching surface that is also transverse to the mating direction. The transverse surfaces of the male and female connectors are engaged by a resilient retainer that is shaped to fit within a retention position between them. When the retainer resides in the retention position, a portion of it is located to a side of the male connector protrusion away from the female connector portion. Likewise, another portion of the retainer is located to a side of the latching surface of the female connector away from the male connector portion. The female portion may include two such latching surfaces that allow a single spring to be used for the retainer such that, in the retention position, each end of the spring is located adjacent to one of the latching surfaces, while a middle portion of the spring is located adjacent to one or more of the protrusions of the male connector portion. With the retainer in the retention position, it provides a retention force that resists a separation of the male and female connector portions. However, the resiliency of the retainer is such that the retention force may be overcome, and the retainer moved out of the retention position, by a sufficiently large separation force applied to pull the connector portions apart. Thus, separation of the connector portions by force alone, whether intentional or accidental, may occur without damage to the retainer or connector portions.

BRIEF DESCRIPTION OF THE DRAWINGS

The above and further advantages of the invention may be better understood by referring to the following description in conjunction with the accompanying drawings in which.

DETAILED DESCRIPTION

Figure 1:
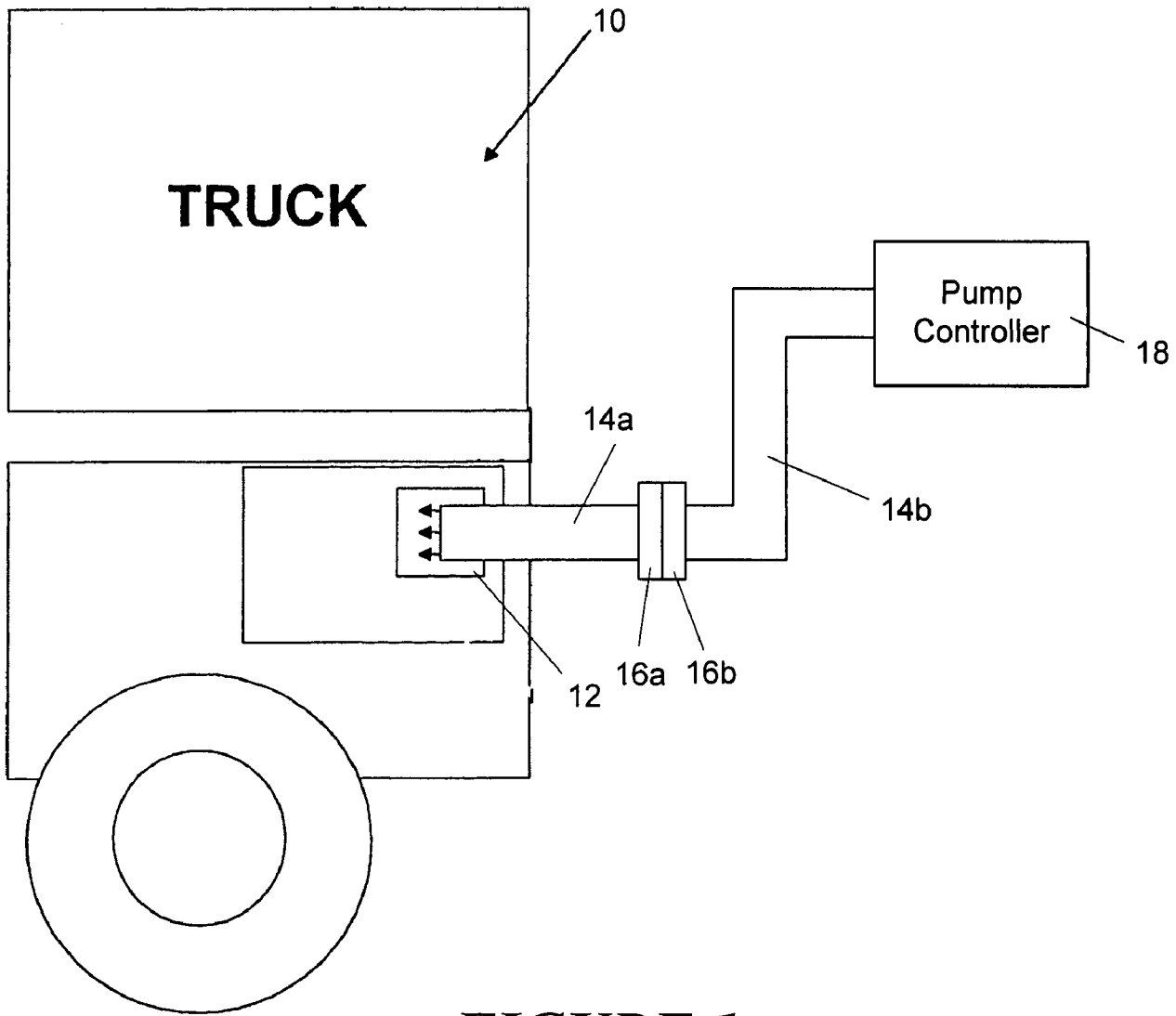
FIG. 1 is a schematic view of part of a tanker truck connected to a pump controller of a loading rack by a connector according to the present invention.

Shown in FIG. 1 is a schematic view of a portion of a truck 10 used for the transportation of petroleum products such as gasoline. The truck has an electronic panel 12 to which is connected to a truck cable portion 14*a*, which has at the opposite end a truck cable connector 16*a*. This cable connector portion 16*a* mates with a pump controller cable connector portion 16*b*, which is connected to pump controller cable 14*b*. The pump controller cable connector portion 16*b* provides electrical signal paths for a pump controller 18 that are used for controlling the pump of a petroleum loading rack to which the truck is connected. The loading rack provides a source of petroleum product that is loaded into a storage tank of the truck 10 via a fluid conduit (not shown). The transfer of the fluid product is preferably conducted under a number of conditions, including various safety and product identification and tracking protocols. Electrical signals used in these protocols are transmitted along the cable 14*a*, 14*b* via the cable connector portions 16*a*, 16*b*. The cable 14*a*, 14*b* and connector portions 16*a*, 16*b* may be compatible with a commercially available pump controller such as, for example, the INTELLITROL® system (INTELLITROL is a registered trademark of Scully Signal Company, Wilmington, Mass.).

One area of concern with regard to the cable 14*a*, 14*b* is the possibility that an operator may forget to disconnect the cable connector portions 16*a*, 16*b* from each other before driving the truck away from the loading rack. The resulting failure may occur along different regions of the cable portions 14*a*, 14*b*, including inflicting serious damage to the interfaces at which the cable portions 14*a*, 14*b* connect, respectively, to their respective signal sources, i.e., the panel 12 or the pump controller 18. One particular failure mode also occurs at the cable connectors 16*a*, 16*b* themselves, where a detent may be broken off of one of the connectors.

The underlying structure of the cable connection may be based on a commercially available cable such as a MOLEX® brand MX150 sealed connector system (MOLEX is a registered trademark of Molex, Inc., Lisle, Ill.). A connector such as this provides a sealed connection, an appropriate number of connection pins, and a detent mechanism that holds the two cable portions together when connected. However, the detent mechanism requires manual intervention if it is to be disconnected without damage. When a sufficient separating force is applied to the cable portions without manual adjustment of the detent, the detent mechanism breaks, and will no longer function to hold the two cable portions together. Once the mechanism is broken, a relatively small force, such as the force exerted by the weight of the cables themselves, may be sufficient to pull the connector portions apart.

Figure 2A:
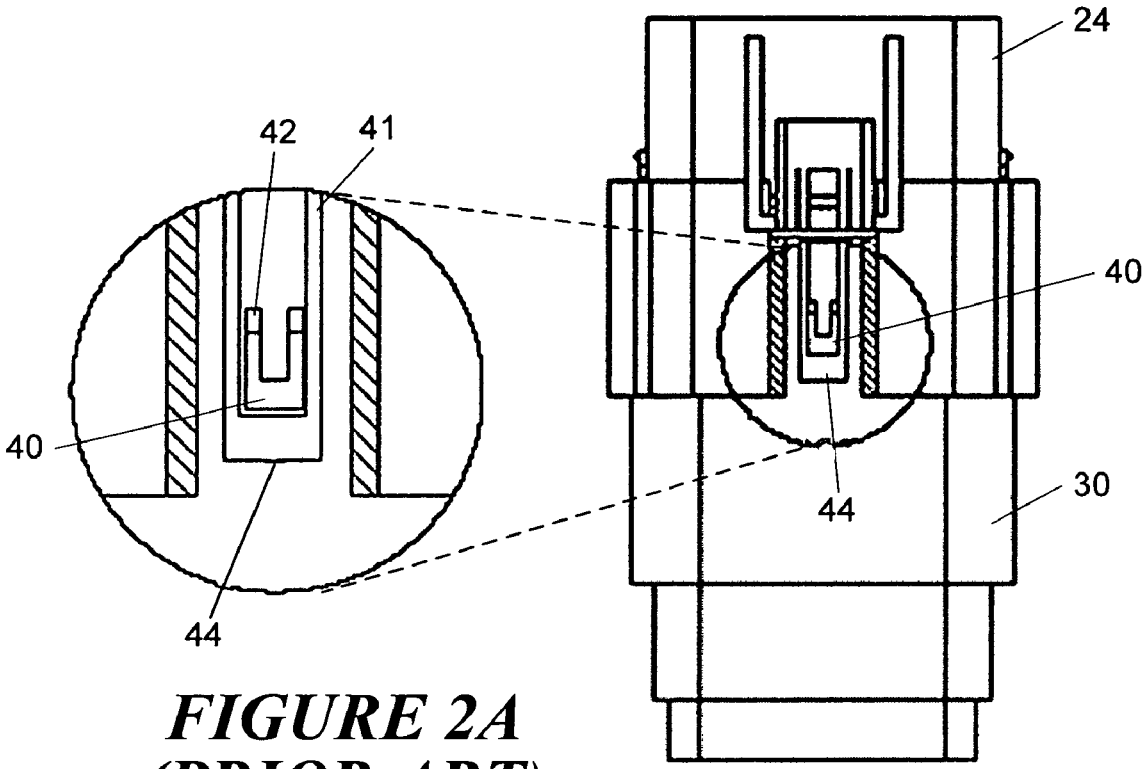
FIGURE 2A (PRIOR ART)
FIGS. 2A and 2B are schematic views of a conventional cable connector having a non-repeatable locking mechanism in, respectively, a locked position and a position in which the locking mechanism is broken.
Figure 2B:
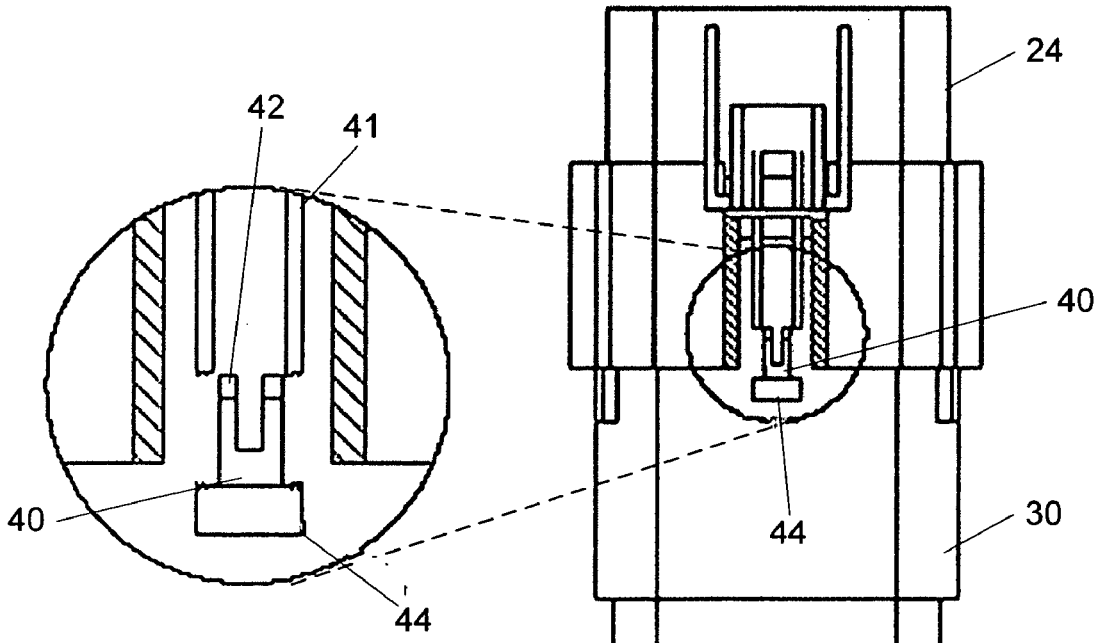
FIGURE 2B (PRIOR ART)

FIGS. 2A and 2B show the failure mode of a MOLEX-type cable connector. In FIG. 2A, two mating connector portions are shown in a connected position. A detent 40 in the form of a protrusion from the surface of the male connector portion 30 is engaged by a flexible arm 41 that is biased to remain adjacent to the surface of the female connector portion 24. The detent has a ramp-like shape 42 on a first side that, when the two connector portions are pushed together, is contacted by the flexible arm 41 and, as the connector portions are pushed further together, forces the arm away from the surface of the female connector portion 24. Once the end 44 of the flexible arm goes beyond the detent, however, the elasticity of the arm causes it to return to a position closer to the connector surface, with the arm end behind the detent 40.

The side of the detent opposite the ramp-like portion 42 is perpendicular to the mating direction of the connector so that, once the end 44 of the flexible arm 41 passes the detent, its new position restricts the arm (and therefore the female connector portion 24) from being pulled away from the male connector portion 30. The two connectors are thereby "locked" together and prevented from separation by small, incidental forces. To separate the connector portions in a repeatable manner requires a user to manually pull the end 44 of the flexible arm 41 away from the main surface of the connector portion so that it is no longer engaged with the detent 40. The two connector portions may then be separated without damage. However, if a larger force is applied to the locking mechanism of the connectors without taking the flexible arm out of engagement with the detent, the locking mechanism will break under the load.

FIG. 2B shows the effects of a large separation force applied to the two connector portions 24, 30. This may occur, for example, if a truck to which one of the cable portions is connected drives away from a loading station to which the other cable portion is connected. As shown in the figure, such a force causes the flexible arm 41 to break, separating the end 44 from the rest of the flexible arm. Once this break occurs, the connector locking feature is no longer functional. As such, although the connector is otherwise still operational, it will no longer prevent separation due to small forces, which may include the weight of one of the cable portions pulling against the connector.

Figure 3:
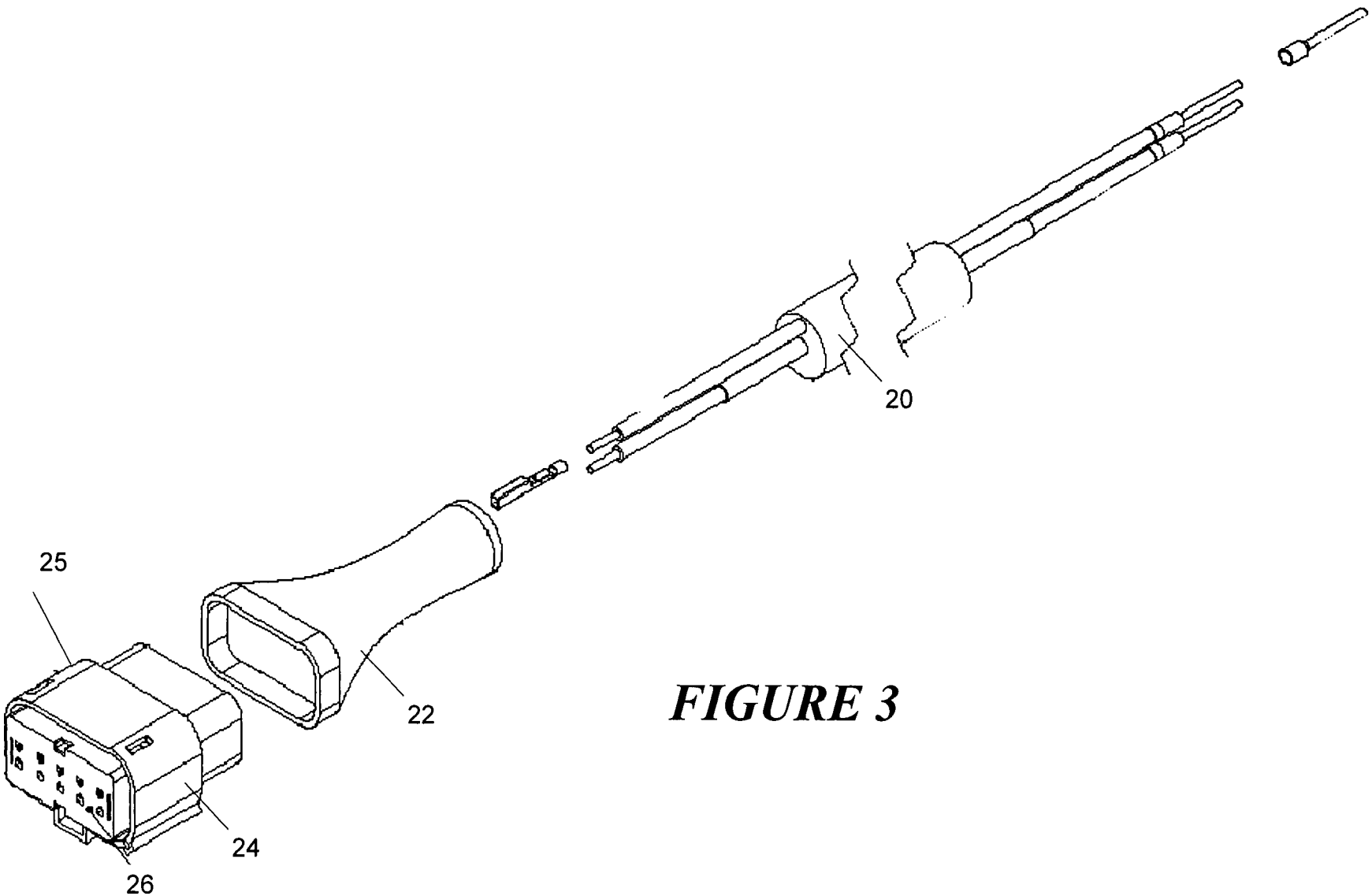
FIG. 3 is an exploded perspective view of a female connector portion along with an attached cable.

FIG. 3 is an exploded view of a cable portion 20 that can serve as either of the cable portions 14*a* or 14*b* shown in FIG. 1. In the FIG. 3, cable portion, the cable sheath is shown in cutaway to reveal the wires within, and a boot 22 is shown at one end of the cable portion. The boot provides a certain degree of protection to the cable against local bending in the vicinity of cable connector portion 24. The cable connector portion 24 may be either of the cable connectors 16*a* or 16*b* shown in FIG. 1, as would be appropriate to use with the cable 20. In this embodiment, the connector portion 24 is a "female" component, and mates with a "male" counterpart. The socket 26 of the connector portion 24 has a plurality of holes that each receive a pin of the male connector portion and is enclosed in a housing 25. Within each of the socket holes is an electrical contact that provides connection to the conductive pin that is inserted therein. In the orientation of FIG. 3, the original "locking mechanism" of the connector portion is on the opposite side of the connector and, therefore, not shown.

Figure 4:
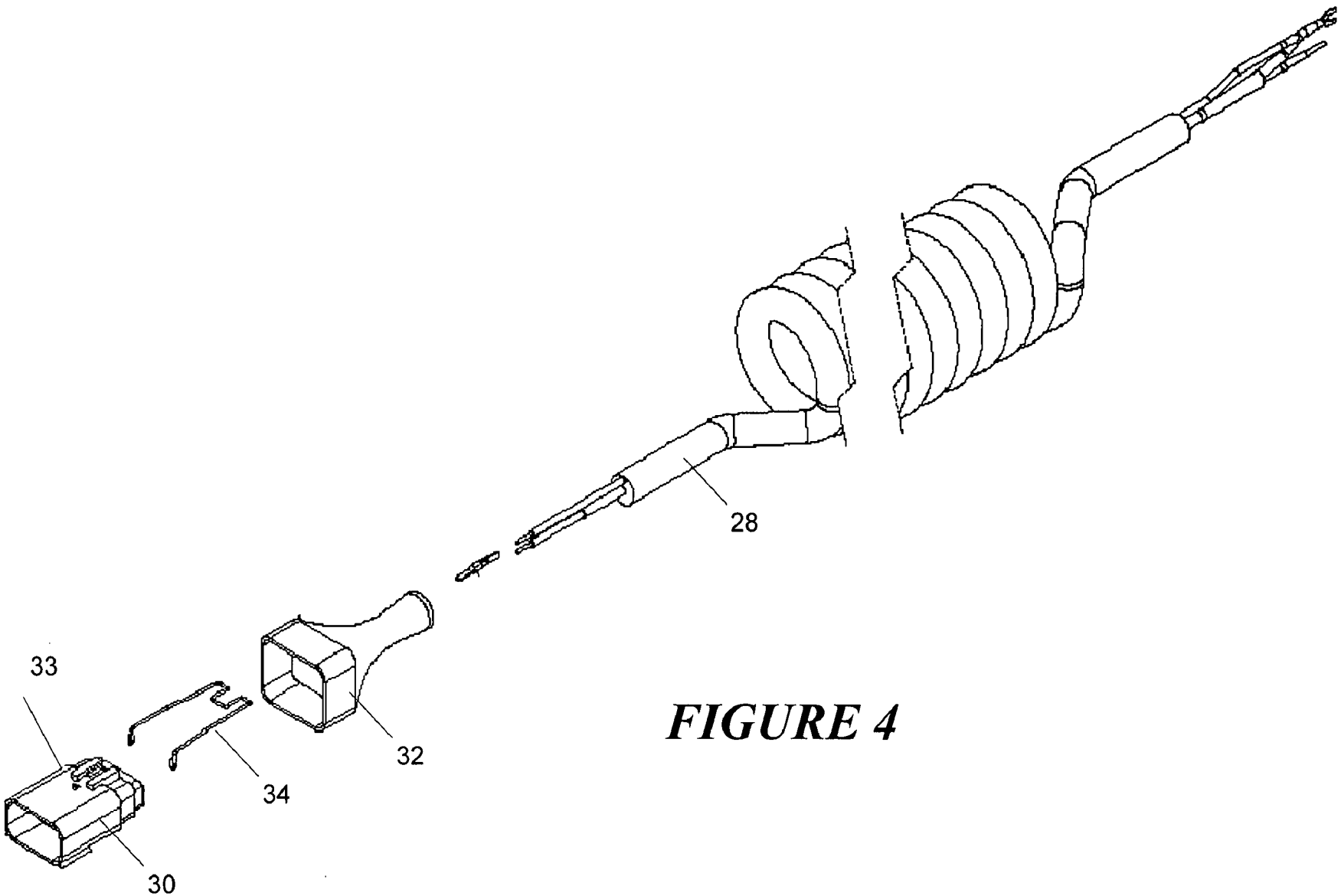
FIG. 4 is an exploded perspective view of a male connector portion along with an attached cable.

FIG. 4 is an exploded view of a cable 28 and connector portion 30 that could be mated with the cable and connector shown in FIG. 2. The cable 28 is shown in partial cutaway to reveal the wires within. The connector portion 30 is a male component that has its pins recessed within an outer housing 33, and those pins are arranged to mesh with the receiving holes of the female connector socket 26 of FIG. 3. In the FIG. 4 cable portion, the cable sheath is shown in cutaway to reveal the wires within, and a boot 32 is shown at one end of the cable portion. The boot 32 provides a certain degree of protection to the cable against local bending in the vicinity of cable connector portion 30. The cable connector portion 30 may be either of the cable connectors 16*a* or 16*b* shown in FIG. 1, as would be appropriate to use with the cable 20. In addition, a retaining spring 34 is shown that is used, in accordance with the principles of the invention, to allow a repeatable "locking" between the connector portions 24, 30 of the two cables, even after the original "locking mechanism" of the connector is broken. In the orientation of FIG. 4, that original locking mechanism is on the opposite side of the connector and, therefore, not shown.

Figure 5:
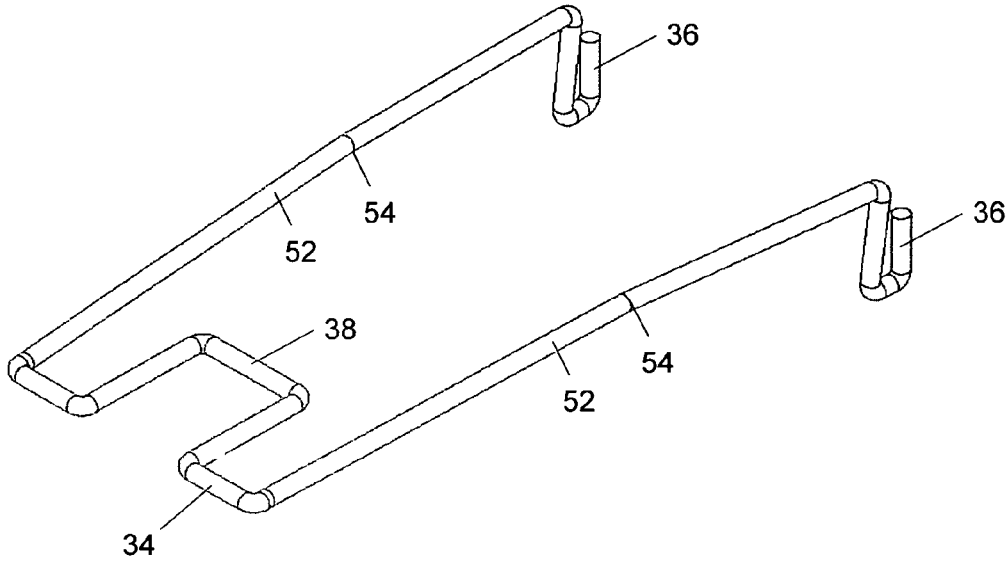
FIG. 5 is a perspective view of a spring used for locking a cable connector according to the present invention.

Shown in FIG. 5 is spring 34 of the connector according to the present invention. The spring may be constructed from a single piece of wire, and has a "W" shape to fit across the connector portions 24, 30 when the connector is engaged. In particular, the spring has a retention loop 38 and two latching fingers 36. One latching finger is formed on the free end of each outer leg. In addition, each of two outer legs 52 has a slight bend 54 that accommodates the shape of the connector when the two connector portions are coupled together. The spring is shown in FIG. 6 in position with an assembled connector.

Figure 6:
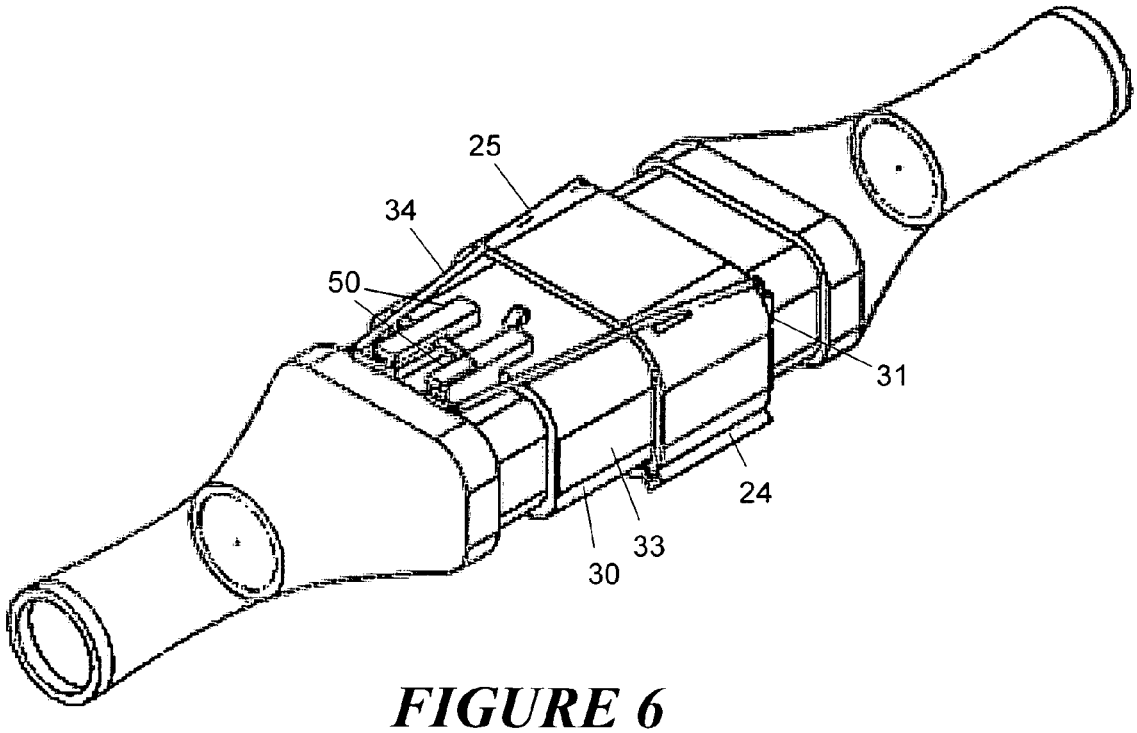
FIG. 6 is a perspective view of the male and female portions of a cable connector according to the present invention locked together in a repeatable manner.

Shown in FIG. 6 are the two connector portions 24, 30 of the present invention coupled together. As in FIGS. 3 and 4, the orientation of this view is such that the conventional locking mechanism of the connector is on the opposite side of the connector, and therefore not shown. On the side of the connector shown, the housing 33 of the connector portion 30 has two parallel protrusions 50 that extend from the connector housing surface. The retention loop 38 of the spring 34 is sized to fit snugly between the protrusions 50, which thereby provide some retention of the spring. The retention loop is at approximately the center of the spring wire, and the two sides of the spring from there wrap around the protrusions 50, and the outer legs 52 are directed toward the other connector portion 24. The bends 54 in the outer legs 52 coincide with the lip formed between the two connectors, and allow the spring to remain flush against the connector portion 24 as well as the portion 30. At the ends of the outer legs 52 of spring 34 are the latching fingers 36, which are angled at approximately 90° relative to the legs 52. The latching fingers thus extend over a shoulder 31 of the connector housing 25 when the two connector portions 24, 30 are coupled together tightly. The shoulder 31 has a surface that extends transversely to the mating direction so that the latching fingers slide over this surface. The latching fingers 36, together with the retention loop 50, thereby establish a restriction on the separation of the connector portions from one another. That is, the spring is biased against the connector portions being pulled apart and keeps them from separating due to a small force such as the weight of the connector portions themselves.

Although the spring 34 retains the connector portions against relatively small forces, a larger force can still pull the connector apart. When enough force is applied to separate the two connector portions, the resiliency of the spring allows the outer legs 52 and latching fingers of the spring to bend far enough that the latching fingers slip over the shoulder 31 of the connector housing 25. Typically, in such a case, the spring will remain attached to the connector housing 33 due to the positioning of the retention loop 38 between the protrusions 50. However, the two connector portions will be allowed to separate. Thus, the connectors themselves will not be damaged by the connector portions being pulled apart. Moreover, the resiliency of the spring 34 is such that, after being pulled over the shoulder 31 of the connector housing 25, the spring resumes its original shape. Thus, the two connector portions may again be connected, and the spring again used to retain them in the coupled position, making the connection "repeatable."

A connector as shown above provides a repeatably releasable locking mechanism for keeping the two connector portions together. This allows use of the connector in situations where a user might accidentally force the connector portions apart (such as in the case of a tanker truck pulling away from a loading rack with the cable portions still connected together), without the resulting destruction of the connector locking mechanism. Thus, it is unnecessary to repair or replace the cable connector after such an accident.

While the invention has been shown and described with reference to certain embodiments thereof, it will be recognized by those skilled in the art that various changes in form and detail may be made therein without departing from the spirit and scope of the invention. For example, the cable connector may be used in any of a number of different applications other than those related to tanker truck loading. Moreover, a spring mechanism in the form shown is only one example of the types of repeatable components that may be used to create a repeatable connection. Those skilled in the art will recognize that other types of analogous mechanisms exist, and those mechanisms are considered to be within the scope of the invention.

What is claimed is:

1. A cable connector having male and female connector sockets that have electrical connectors therein and slide together in a mating direction to electrically connect two multi-wire cables, comprising:

a housing enclosing one connector socket and having a shoulder with a surface transverse to the mating direction;

a second housing enclosing the other connector portion; and a resilient retainer spring attached to the second housing and extending parallel to the mating direction, wherein the second housing has a pair of protrusions and wherein the retainer spring has a retention loop that fits between the pair of protrusions in order to attach the retainer spring to the second housing, the retainer spring further having a finger that extends transverse to the mating direction, so that when the connector portions are mated, the finger slips over the shoulder surface and is held in position by the resilience of the spring to provide a retention force that resists a separation of the male and female connector portions, wherein the finger is shaped and resilience of the retainer spring is such that the finger slips off the shoulder surface upon application of a separation force greater than a predetermined magnitude between the male and female connector portions.

2. The cable connector of claim 1 wherein the retention loop fits tightly between the pair of protrusions so that the retainer spring is attached to the second housing by a friction fit.

3. The cable connector of claim 1 wherein the retainer spring has two fingers, each finger extending transverse to the mating direction.

4. The cable connector of claim 3 wherein the retainer spring has a "W" shape and wherein each outer leg of the "W" shape has a finger on its free end.

5. The cable connector of claim 4 further comprising a second housing enclosing the other connector portion, the second housing having a first protrusion that slides into one side of the "W" shape and a second protrusion that slides into the other side of the "W" shape.

6. The cable connector of claim 1 wherein the retainer spring is formed from resilient wire.

7. A cable assembly for connecting a truck to a pump controller, the cable assembly comprising:

a multi-wire cable connected to the truck;

a multi-wire cable connected to the pump controller;

a cable connector having male and female connector sockets that have electrical connectors therein and slide together in a mating direction to electrically connect the two multi-wire cables;

a housing enclosing one connector socket and having a shoulder with a surface transverse to the mating direction;

a second housing enclosing the other connector portion; and a resilient retainer spring attached to the second housing and extending parallel to the mating direction, wherein the second housing has a pair of protrusions and wherein the retainer spring has a retention loop that fits between the pair of protrusions in order to attach the retainer spring to the second housing, the retainer spring further having a finger that extends transverse to the mating direction, so that when the connector portions are mated, the finger slips over the shoulder surface and is held in position by the resilience of the spring to provide a retention force that resists a separation of the male and female connector portions, wherein the finger is shaped and resilience of the retainer spring is such that the finger slips off the shoulder surface upon application of a separation force greater than a predetermined magnitude between the male and female connector portions.

8. The cable assembly of claim 7 wherein the retention loop fits tightly between the pair of protrusions so that the retainer spring is attached to the second housing by a friction fit.

9. The cable assembly of claim 7 wherein the retainer spring has two fingers, each finger extending transverse to the mating direction.

10. The cable assembly of claim 9 wherein the retainer spring has a "W" shape and wherein each outer leg of the "W" shape has a finger on its free end.

11. The cable assembly of claim 10 further comprising a second housing enclosing the other connector portion, the second housing having a first protrusion that slides into one side of the "W" shape and a second protrusion that slides into the other side of the "W" shape.

12. The cable assembly of claim 7 wherein the retainer spring is formed from resilient wire.

* * * * *